US012490815B2

(12) United States Patent
Chi et al.

(10) Patent No.: US 12,490,815 B2
(45) Date of Patent: Dec. 9, 2025

(54) WEARABLE DEVICE

(71) Applicant: GOERTEK INC., Weifang (CN)

(72) Inventors: Xiaocheng Chi, Weifang (CN); Guanyu Wang, Weifang (CN); Wei Tang, Weifang (CN)

(73) Assignee: GOERTEK INC., Weifang (CN)

( * ) Notice: Subject to any disclaimer, the term of this patent is extended or adjusted under 35 U.S.C. 154(b) by 90 days.

(21) Appl. No.: 18/591,096

(22) Filed: Feb. 29, 2024

(65) Prior Publication Data

US 2024/0197045 A1 Jun. 20, 2024

Related U.S. Application Data

(63) Continuation of application No. PCT/CN2021/138207, filed on Dec. 15, 2021.

(30) Foreign Application Priority Data

Nov. 26, 2021 (CN) ..... 202111428296.3

(51) Int. Cl.
*A44C 5/14* (2006.01)

(52) U.S. Cl.
CPC ..... *A44C 5/147* (2013.01)

(58) Field of Classification Search
CPC . Y10T 24/4782; A44C 5/0007; A44C 5/0015; A44C 15/0025; A44C 17/0216; A44C 17/0225; A44C 5/00; A44C 5/12; A44C 5/14; A45F 5/1516; A45F 2005/008; G04G 17/045; G04G 17/08; A41D 20/00; G04B 37/1486; G04B 37/146
(Continued)

(56) References Cited

U.S. PATENT DOCUMENTS 9,612,578 B2 * 4/2017 Huang ..... G06F 1/163
2020/0268113 A1 8/2020 Cao

FOREIGN PATENT DOCUMENTS

CH 715870 A1 8/2020
CN 203986418 U 12/2014
(Continued)

OTHER PUBLICATIONS

First Office Action in Corresponding Chinese Application No. 202111428296.3, dated Apr. 28, 2022; 14 pgs.
(Continued)

*Primary Examiner* — Jack W Lavinder
(74) *Attorney, Agent, or Firm* — HAUPTMAN HAM, LLP

(57) ABSTRACT

Disclosed is a wearable device, including: a connecting member, a device main body, a band body, a limiting clamping groove, an installation groove, and a limiting member; the device main body is detachably connected to a peripheral wall of the connecting member; the band body is connected to two opposite ends of the connecting member; the limiting clamping groove is provided at one of the connecting member and the device main body; the installation groove is provided on the other one of the connecting member and the device main body, a notch of the installation groove is provided opposite to a notch of the limiting clamping groove; and the limiting member is rotatably provided in the installation groove to have a locking position and an unlocking position, the limiting member is provided with a limiting clamping convex for snapping into the limiting clamping groove.

14 Claims, 7 Drawing Sheets

(58) Field of Classification Search
USPC ..... 368/316, 317, 281, 282, 283; 70/DIG. 9, 70/162; 63/3; 224/169, 170
See application file for complete search history.

(56) References Cited

FOREIGN PATENT DOCUMENTS

| | | | |
|---|---|---|---|
| CN | 204682716 | U | 10/2015 |
| CN | 109008099 | A | 12/2018 |
| CN | 110507042 | A | 11/2019 |
| CN | 110632841 | A | 12/2019 |
| CN | 209711767 | U | 12/2019 |
| CN | 210043322 | U | 2/2020 |
| CN | 110897279 | A | 3/2020 |
| CN | 111528587 | A | 8/2020 |
| CN | 211459081 | U | 9/2020 |
| CN | 211608393 | U | 10/2020 |
| CN | 112120364 | A | 12/2020 |
| CN | 112186838 | A | 1/2021 |
| CN | 212661270 | U | 3/2021 |
| CN | 212938383 | U | 4/2021 |
| CN | 113598494 | A | 11/2021 |
| DE | 3440431 | A1 * | 6/1984 |

OTHER PUBLICATIONS

Grant Notification in Corresponding Chinese Application No. 202111428296.3, dated Oct. 28, 2022; 7 pgs.
International Search Report and Written Opinion in Corresponding International Application No. PCT/CN2021/138207, mailed Jun. 30, 2022; 12 pgs.

* cited by examiner

WEARABLE DEVICE

CROSS-REFERENCE TO RELATED APPLICATIONS

The present application is a continuation application of International Application No. PCT/CN2021/138207, filed on Dec. 15, 2021, which claims priority to Chinese Patent Application No. 202111428296.3, filed on Nov. 26, 2021. The disclosures of the above-mentioned applications are incorporated herein by reference in their entireties.

TECHNICAL FIELD

The present application relates to the technical field of wearable devices, and in particular to a wearable device.

BACKGROUND

With the development of electronic technology, wearable devices are becoming more and more popular. The wearable device generally includes a device main body and a band body. The device main body is used to display image information to the user, and the band body is used to wear the device main body on the user's head, wrist or foot. When the band body is damaged or stained, or the device main body fails, it is often necessary to replace the band body or the device main body separately. In addition, when users wear wearable devices, especially wrist-worn devices, they often need to consider matching their clothing, which often needs to change the corresponding style of the band body for the wrist-worn device according to different dressing styles. However, in existing wearable devices, the disassembly of the band body is very cumbersome and is not conducive to user's operation.

SUMMARY

The main purpose of the present application is to provide a wearable device, aiming to enable the band body and device main body to be disassembled easily and quickly.

In order to achieve the above purpose, the present application provides a wearable device, including: a connecting member, a device main body, a band body, a limiting clamping groove, an installation groove, and a limiting member;

the device main body is detachably connected to a peripheral wall of the connecting member;

the band body is connected to two opposite ends of the connecting member;

the limiting clamping groove is provided at one of the connecting member and the device main body;

the installation groove is provided on the other one of the connecting member and the device main body, a notch of the installation groove is provided opposite to a notch of the limiting clamping groove; and the limiting member is rotatably provided in the installation groove to have a locking position and an unlocking position, the limiting member is provided with a limiting clamping convex for snapping into the limiting clamping groove;

in the locking position, the limiting clamping convex is exposed to the notch of the installation groove and snapped into the limiting clamping groove; and in the unlocking position, the limiting clamping convex is separated from the limiting clamping groove.

In an embodiment, the installation groove is provided in the device main body, and the limiting clamping groove is formed in the connecting member.

In an embodiment, the wearable device further includes a reset member configured to act on the limiting member, so that the limiting member has a tendency to move toward the locking position.

In an embodiment, the reset member includes a first magnetic member provided on the device main body and a second magnetic member provided on the limiting member, the first magnetic member is provided opposite to the second magnetic member, and the first magnetic member is interacted with the second magnetic member, so that the limiting member has the tendency to move toward the locking position.

In an embodiment, the installation groove is provided with a first groove wall and a second groove wall opposite to the first groove wall;

the first magnetic member is provided on the first groove wall, and opposite sides between the first magnetic member and the second magnetic member are of a same magnetic pole; the first magnetic member is repelled with the second magnetic member so that the limiting member is abutted against the second groove wall, and the limiting member reaches the locking position; or the first magnetic member is provided on the second groove wall, and opposite sides between the first magnetic member and the second magnetic member are of a different magnetic pole; the first magnetic member is attracted to the second magnetic member, so that the limiting member is abutted against the second groove wall, and the limiting member reaches the locking position.

In an embodiment, the wearable device further includes a driving member movably provided in the device main body to have a first position and a second position;

the driving member is provided with a trigger end exposed outside the device main body; and the driving member is configured to move from the first position to the second position, and configured to drive the limiting member to move from the locking position to the unlocking position.

In an embodiment, the device main body is further provided with a guiding groove communicated with the installation groove, and the driving member is movably installed in the guiding groove and configured to move between the first position and the second position along a groove depth direction of the guiding groove.

In an embodiment, the device main body is further provided with an elastic member configured to act on the driving member, so that the driving member has a tendency to move toward the first position.

In an embodiment, the guiding groove is provided with a first side and a second side opposite to the first side in the groove depth direction, and the first side is provided at a connection between the installation groove and the guiding groove; and one end of the driving member close to the first side is provided with a first limiting convex portion, the second side of the guiding groove is provided with a second limiting convex portion, and the first limiting convex portion is limited to one side of the second limiting convex portion away from the second side, so as to avoid the driving member separating from the guiding groove through the second side.

In an embodiment, the elastic member is provided in the installation groove; one end of the elastic member is connected to a wall of the installation groove, and the other end of the elastic member is connected to an end portion of the driving member close to the first side; the driving member is avoided separating from the guiding groove through the first side under an action of the elastic member.

In an embodiment, a first installation convex portion is protruded on a wall of the installation groove opposite to the first side, and a second installation convex portion is protruded at one end portion of the driving member close to the first side; the elastic member is configured as a spring, and both ends of the spring are respectively installed on the first installation convex portion and the second installation convex portion.

In an embodiment, the device main body is provided with a positioning convex portion, and the connecting member is provided with a positioning breach; the positioning convex portion is snapped into the positioning breach, and the limiting clamping convex is snapped into the limiting clamping groove.

In an embodiment, the wearable device further includes a wearing side, the connecting member is provided with an installation port provided on the wearing side, and the device main body is installed into the connecting member from the installation port.

In an embodiment, the limiting clamping convex is provided with a first guiding slope away from the wearing side of the device main body; in response to that the limiting member is in the locking position, the first guiding slope is configured to guide the device main body to be installed into the connecting member from the installation port and to be pushed so that the limiting member reaches the unlocking position.

In an embodiment, a second guiding slope is provided on one side of the limiting clamping groove close to the installation port, and the limiting member is configured to move from the locking position to the unlocking position and separate from the limiting clamping groove through the second guiding slope.

In an embodiment, a first slope is formed on an outer peripheral edge of the device main body, and a second slope parallel to the first slope is formed on a peripheral wall of the connecting member; the second slope is extended inwardly from the installation port; the first slope is cooperated with the second slope to guide the device main body to separate from the connecting member through the installation port and avoid the device main body separating from the connecting member through an opposite side of the installation port.

In an embodiment, a limiting portion is protruded on an inner circumference of the connecting member, and the limiting portion is provided on the opposite side of the installation port to avoid the device main body separating from the connecting member through the opposite side of the installation port.

In the technical solution of the present application, the process of disassembling and assembling the band body and the device main body is essentially disassembling and assembling the connecting member and the device main body. By driving the limiting member to rotate to the unlocking position, the limiting clamping convex is separated from the limiting clamping groove, and the user can drive the device main body move relative to the connecting member, so that the device main body can be inserted into the annular inner wall, or the device main body can be separated from the connecting member. After the device main body is inserted into the annular inner wall, by driving the limiting member to rotate to the locking position, the limiting clamping convex can be snapped into the limiting clamping groove, the relative movement of the connecting member and the device main body is limited, and the band body can be fixedly connected to the device main body. As a result, the band body and the device main body of the wearable device of the present application can be easily and quickly disassembled and assembled, which is conducive to improving the user's operating experience of replacing the band body.

BRIEF DESCRIPTION OF THE DRAWINGS

In order to illustrate the technical solutions in the embodiments of the present application or in the related art more clearly, the following briefly introduces the accompanying drawings required for the description of the embodiments or the related art. Obviously, the drawings in the following description are only part of embodiments of the present application. For those skilled in the art, other drawings can also be obtained according to the structures shown in these drawings without any creative effort.

Figure 1:
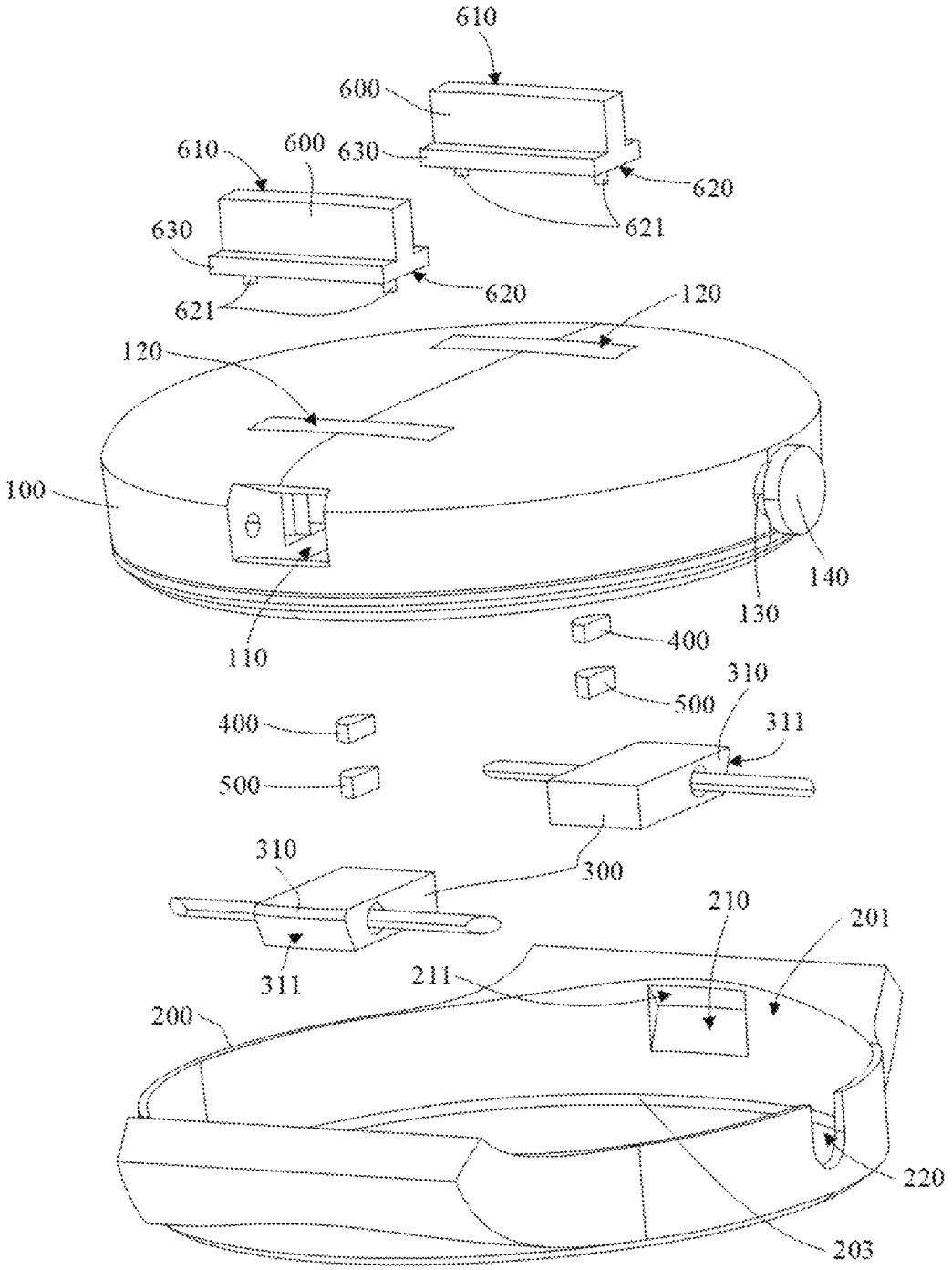
FIG. 1 is an exploded view of a wearable device according to an embodiment of the present application.

The realization of the objective, functional characteristics, and advantages of the present application are further described with reference to the accompanying drawings.

DETAILED DESCRIPTION OF THE EMBODIMENTS

The technical solutions of the embodiments of the present application will be described in more detail below with reference to the accompanying drawings. It is obvious that the embodiments to be described are only some rather than all of the embodiments of the present application. All other embodiments obtained by those skilled in the art based on the embodiments of the present application without creative efforts shall fall within the scope of the present application.

It should be noted that all directional indications (such as up, down, left, right, front, back, etc.) in the embodiments of the present application are only used to explain the relative positional relationship, the movement situation, etc. among various assemblies under a certain posture as shown in the drawings. If the specific posture changes, the directional indication also changes accordingly.

In addition, the descriptions of "first", "second", etc. are only for the purpose of description, and should not be construed as indicating or implying relative importance or implicitly indicating the number of technical features indicated. Thus, a feature delimited with "first", "second" May expressly or implicitly include at least one of that feature. Besides, the meaning of "and/or" appearing in the application includes three parallel scenarios. For example, "A and/or B" includes only A, or only B, or both A and B. In addition, the technical solutions between the various embodiments can be combined with each other, but must be based on the realization by those skilled in the art. When the combination of technical solutions is contradictory or cannot be realized, it should be considered that the combination of such technical solutions does not exist or fall within the scope of protection claimed in the present application.

The present application provides a wearable device. It can be understood that the wearable device includes: a watch, a smart watch or a smart bracelet that can be worn on the wrist, a motion monitoring module that can be worn on the ankle, and a three dimensional (3D) display device that can be worn on the head, etc.

Figure 2:
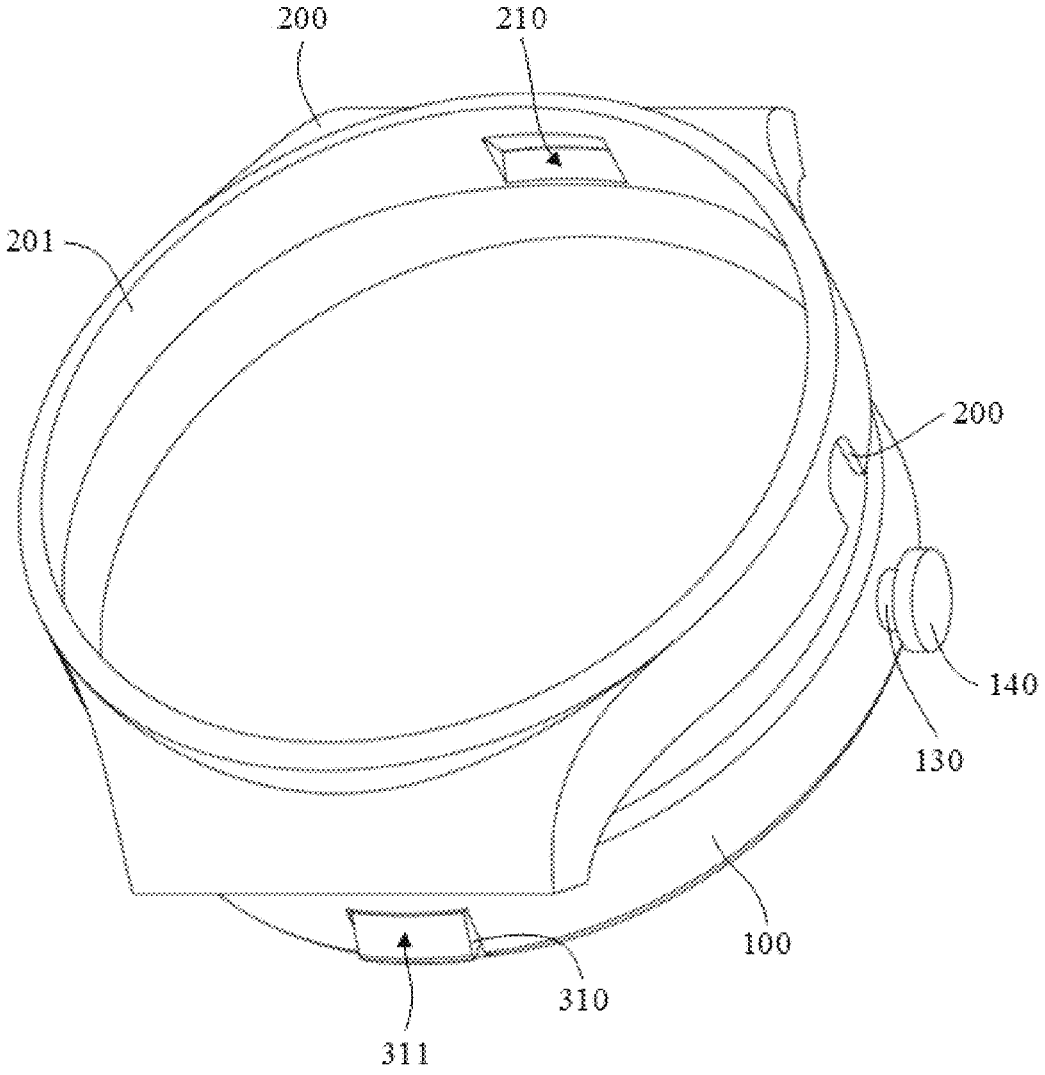
FIG. 2 is an assembly view of the wearable device according to an embodiment of the present application.

In an embodiment of the present application, as shown in FIG. 1 and FIG. 2, the wearable device includes: a device main body 100, a connecting member 200, a band body, a limiting clamping groove 210, an installation groove 110 and a limiting member 300.

The device main body 100 is detachably connected to a peripheral wall of the connecting member 200;

- the band body is connected to opposite ends of the connecting member 200;
- the limiting clamping groove 210 is provided at one of the connecting member 200 and the device main body 100;
- the installation groove 110 is provided at the other one of the connecting member 200 and the device main body 100, and a notch of the installation groove 110 is opposite to a notch of the limiting clamping groove 210; and
- the limiting member 300 is rotatably provided at the installation groove 110 to have a locking position and an unlocking position. The limiting member 300 is provided with a limiting clamping convex 310 for engaging with the limiting clamping groove 210.

In the locking position, the limiting clamping convex 310 is exposed to the notch of the installation groove 110 and snapped into the limiting clamping groove 210; in the unlocking position, the limiting clamping convex 310 is separated from the limiting clamping groove 210.

It can be understood that an installation space is limited inside the connecting member 200 for the device main body 100 to accommodate. After the device main body 100 is installed into the connecting member 200, the device main body 100 will be connected to the peripheral wall of the connecting member 200. When the limiting member 300 is in the locking position, the limiting clamping convex 310 is snapped into the limiting clamping groove 210, which can limit a relative displacement between an annular inner wall 204 and the device main body 100, so that the connecting member 200 remains relatively fixed with the device main body 100. When the limiting clamping convex 310 is separated from the limiting clamping groove 210, and the annular inner wall 204 can move relative to the device main body 100, so that the device main body 100 can move in and out of the installation space inside the connecting member 200.

When assembling the device main body 100 and the band body, the limiting member 300 is rotated to the unlocking position and the device main body 100 is inserted into the connecting member 200. When the device main body 100 is inserted, that is, the notch of the installation groove 110 is opposite to the notch of the limiting clamping groove 210, the limiting member 300 is driven to rotate to the locking position, and the limiting clamping convex 310 can be exposed from the notch of the installation groove 110 and snapped into the limiting clamping groove 210, so that the device main body 100 is fixed with the connecting member 200, and the band body can also be fixedly connected to the device main body 100. When disassembling the device main body 100 and the band body, the limiting member 300 is rotated to the unlocking position, the limiting clamping convex 310 is detached from the limiting clamping groove 210, and the device main body 100 moves relative to the peripheral wall of the connecting member 200, so as to be separated from the connecting member 200. Therefore, the band body can also be separated from the device main body 100.

In the wearable device of the present application, the process of disassembly and assembly of the band body and the device main body 100 is essentially the disassembly and assembly of the connecting member 200 and the device main body 100. By driving the limiting member 300 to rotate to the unlocking position, the limiting clamping convex 310 is separated from the limiting clamping groove 210, and the user can drive the device main body 100 to move relative to the connecting member 200, so that the device main body 100 is installed into the connecting member 200, or the device main body 100 is separated from the connecting member 200. After the device main body 100 is installed in place, the limiting member 300 is driven to rotate to the locking position, so that the limiting clamping convex 310 can be snapped into the limiting clamping groove 210, thereby limiting the relative motion of the annular inner wall 204 and the device main body 100, and the band body can be fixedly connected to the device main body 100. Therefore, the band body and the device main body 100 of the wearable device of the present application can be disassembled and assembled conveniently and quickly, which is beneficial to improving the user's operating experience of replacing the band body.

Appropriately increasing the number of the limiting member 300 will help to improve the connection stability of the device main body 100 and the connecting member 200. However, if there are too many limiting members 300, the efficiency of disassembly and assembly will also decrease accordingly. Therefore, two or three limiting members 300 are appropriate. The number of the installation groove 110 and the limiting clamping groove 210 can correspond to the number of the limiting members 300, or there can be a plurality of limiting members 300 installed in one installation groove 110, and one limiting clamping groove 210 can be provided with a plurality of buckle placements for the limiting clamping convex 310 to engage. In addition, in order to ensure the uniform force between the device main body 100 and the connecting member 200, the limiting member 300 should be evenly distributed in a circumferential direction of the device main body 100 or the peripheral wall of the connecting member 100.

Further, as shown in FIG. 1 and FIG. 2, in this embodiment, the installation groove 110 is provided on the device main body 100, and the limiting clamping groove 210 is formed on the peripheral wall of the connecting member 200. Specifically, the installation groove 110 is provided through a side surface of the device main body 100 for mating with the annular inner wall 204. Therefore, the notch of the installation groove 110 can be towards the peripheral wall of the connecting member 200 and can be opposite to the notch of the limiting clamping groove 210. It can be understood that the device main body 100 is relatively large, an installation groove 110 is provided in the device main body 100, and the space of the installation groove 110 is enough for the limiting member 300 to be rotatably installed. In this embodiment, two limiting members 300, two installation grooves 110 and two limiting clamping grooves 210 are provided. The two installation grooves 110 are provided on opposite sides of the device main body 100 facing away from each other, and the two limiting clamping grooves 210 are provided on the peripheral wall of the connecting member 200 and opposite to each other, and the two limiting members 300 are installed in the two installation grooves 110 correspondingly. Of course, in other embodiments, the installation groove 110 may be provided in the connecting member 200, and the limiting clamping groove 210 may be provided in the device main body 100. At this time, the position where the installation groove 110 is provided in the connecting member 200 may be appropriately widened, so as to provide more space for the installation groove 110.

Further, in this embodiment, as shown in FIG. 1 and FIG. 2, the device main body 100 is provided with a positioning convex portion 130, the connecting member 200 is provided with a positioning breach 220, the positioning convex portion 130 is snapped into the positioning breach 220, and the limiting clamping convex 310 can be correspondingly snapped into the limiting clamping groove 210. In this way, when assembling the connecting member 200 and the device main body 100, the user can first position the positioning breach 220 through the positioning convex portion 130, then insert the device main body 100 into the connecting member 200. In this way, when the device main body 100 is inserted into place, the notch of the limiting clamping groove 210 can be opposite to the notch of the installation groove 110. Further, a shielding portion 140 is provided in a direction of the positioning convex portion 130 away from the device main body 100. The shielding portion 140 is used to block a matching seam of the positioning convex portion 130 and the positioning breach 220 to avoid affecting the appearance beauty of the wearable device main body 100. Of course, in other embodiments, the device main body 100 and the connecting member 200 may be provided with corresponding positioning marks. Before inserting the device main body 100 into the connecting member 200, the positioning marks of the two can be aligned.

Further, in this embodiment, the wearable device is provided with a wearing side p, the connecting member 200 is provided with an installation port 201 at the wearing side p, and the device main body 100 is installed into the connecting member 200 through the installation port 201. It can be understood that when the user wears the wearable device of the present application, the wearing side p of the device main body 100 will be opposite to the human skin. When the device main body 100 is installed into the connecting member 200, the wearing side p of the device main body 100 will be pushed, and the display portion of the device main body 100 provided on the opposite side of the wearing side p will not be squeezed by fingers, which can avoid fingerprints on the surface of the display portion or structural damage caused by excessive external force.

Figure 3:
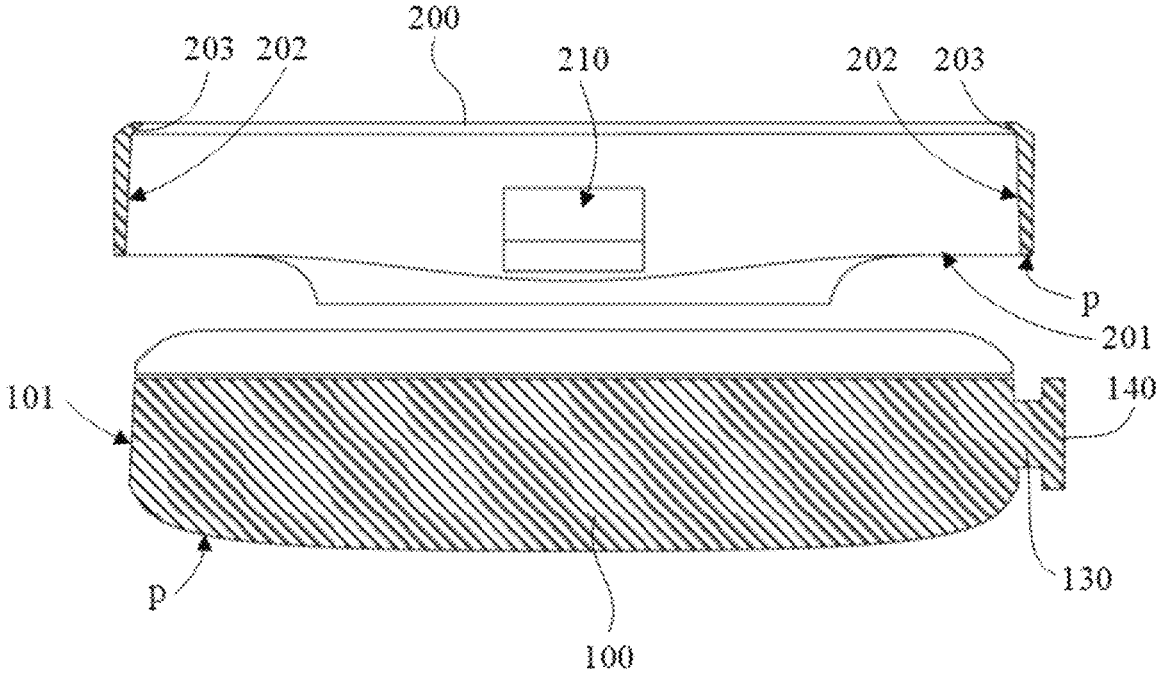
FIG. 3 is a cross-sectional view of a device main body and a connecting member of the wearable device according to an embodiment of the present application.

In an embodiment, as shown in FIG. 3, a first slope 101 is formed on the outer peripheral edge of the device main body 100, and a second slope 202 parallel to the first slope 101 is formed on the inner side of the peripheral wall of the connecting member 200. The second slope 202 is extended inward from the installation port 201. The first slope 101 is cooperated with the second slope 202 to guide the device main body 100 to detach from the connecting member 200 through the installation port 201, and restrict the device main body 100 to detach from the connecting member 200 through the opposite side of the installation port 201. In this embodiment, the first slope 101 extends and closes on the outer peripheral edge of the device main body 100, and the second slope 202 also extends and closes on the inner side of the peripheral wall of the connecting member 200. Therefore, an outer diameter of the device main body 100 and an inner diameter of the connecting member 200 gradually increase in a direction away from the wearing side p. It can be understood that when the user wears the wearable device of the present application, the device main body 100 cannot come out in the direction of the wearing side p due to the restriction of the wearing part, that is, the device main body 100 cannot be separated from the connecting member 200 through the installation port 201. In this embodiment, under the limited cooperation of the first slope 101 and the second slope 202, the device main body 100 cannot be separated from the connecting member 200 through the opposite side of the installation port 201, that is, through the opposite side of the wearing side p. In this way, even if the user performs strenuous exercise, the device main body 100 can be stably connected to the connecting member 200, which is beneficial to improving the user's wearing experience. When the user disassembles the device main body 100 and the band body, the device main body 100 needs to move toward the wearing side p relative to the connecting member 200. At this time, under the guidance of the first slope 101 and the second slope 202, the device main body 100 can be easily detached from the connecting member 200 through the installation port 201.

In an embodiment, as shown in FIG. 1 and FIG. 3, the inner circumference of the connecting member 200 is protrudingly provided with a limiting portion 203. The limiting portion 203 is provided on the opposite side of the installation port 201 to avoid the device main body 100 separating from the connecting member 200 through the opposite side of the installation port 201. In this way, similarly, the device main body 100 cannot be separated from the connecting member 200 through the opposite side of the installation port 201, that is, the opposite side of the wearing side p. When the user wears the wearable device, with the two-way limitation of the limiting portion 203 and the wearing part, even if the user performs strenuous exercise, the device main body 100 can be stably connected to the connecting member 200 without being thrown away. Particularly, when the inner circumference of the connecting member 200 is provided with both the limiting portion 203 and the second slope 202, the limiting portion 203 is connected to one side of the second slope 202 away from the wearing side p and protrudes inward from the second slope 202. In other embodiments, the limiting clamping convex 310 may be snapped into the limiting clamping groove 210 to avoid the device main body 100 from coming out of the connecting member 200 through the opposite side of the installation port 201.

Figure 4:
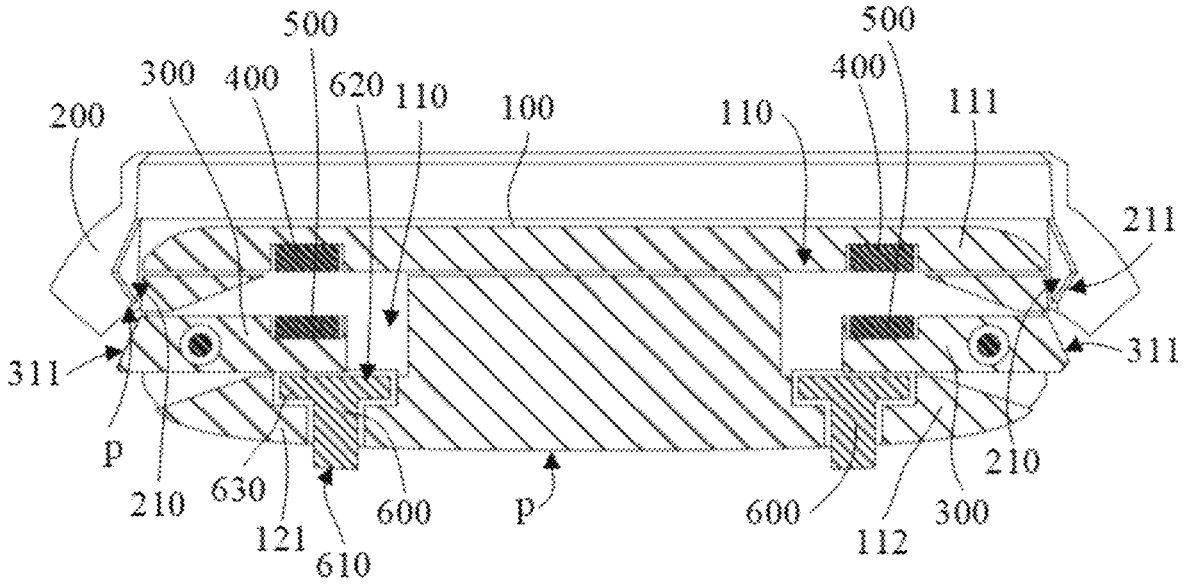
FIG. 4 is a schematic structural view of the device main body and the connecting member in an initial assembly state (when the limiting member is in a locking position) of the wearable device according to an embodiment of the present application.
Figure 5:
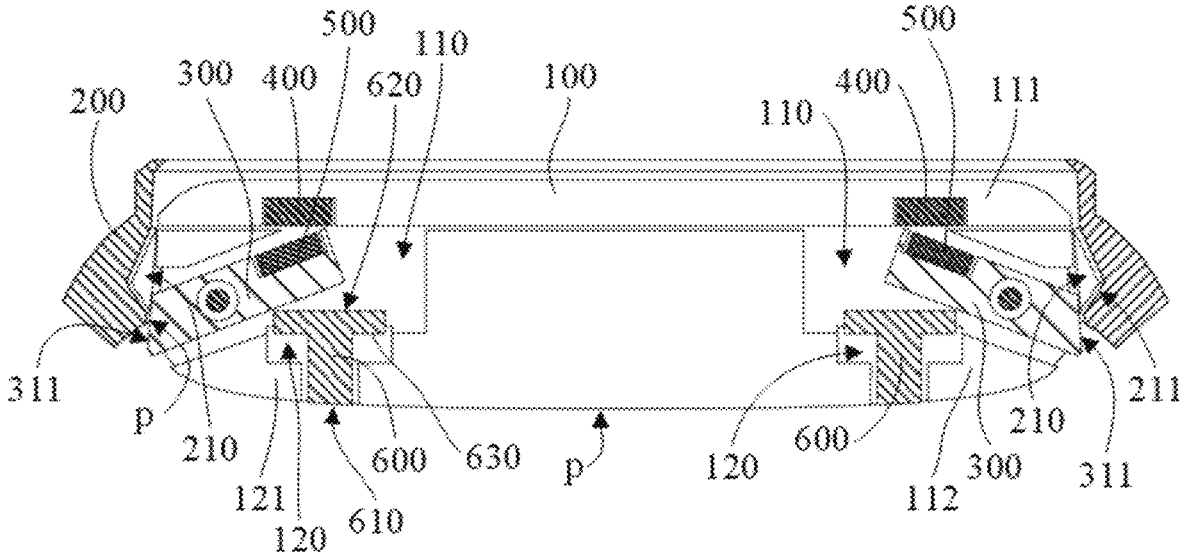
FIG. 5 is a schematic structural view of the device main body and the connecting member in an intermediate assembly state (when the limiting member is in an unlocking position of the wearable device according to an embodiment of the present application.
Figure 6:
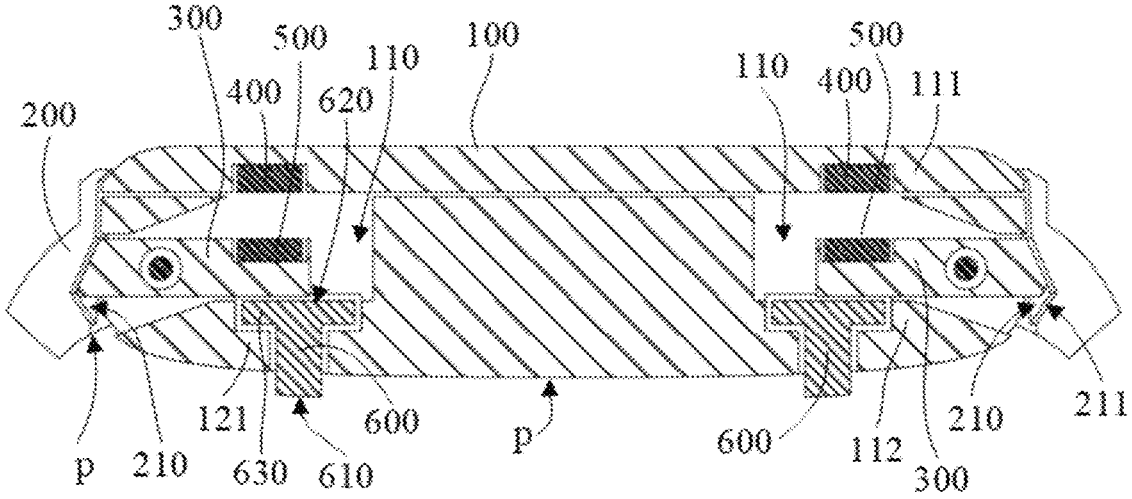
FIG. 6 is a schematic structural view of the device main body and the connecting member in a final assembly state (when the limiting member is in the locking position) of the wearable device according to an embodiment of the present application.

Further, in this embodiment, as shown in FIG. 1, the limiting clamping convex 310 is provided with a first guiding slope 311. As shown in FIG. 4 to FIG. 6, when the limiting member 300 is in the locking position, the device main body 100 can be guided by the first guiding slope 311 to load into the connecting member 200 through the installation port 201, and can be pushed so that the limiting member 300 can reach the unlocking position. In this way, when assembling the device main body 100 and the connecting member 200, the limiting member 300 does not need to be in the unlocking position. Even if the limiting member 300 is in the locking position as shown in FIG. 4, under the guidance of the first guiding slope 311, the device main body 100 can also be inserted into the connecting member 200 smoothly. It can be understood that when assembling the device main body 100 and the connecting member 200, the user inserts the device main body 100 through the installation port 201 of the connecting member 200. The opposite side of the wearing side p of the device main body 100 will first be contact with inner periphery of the connecting member 200, and the first guiding slope 311 should be away from the wearing side p of the device main body 100, so that when the inner wall at the installation port 201 of the connecting member 200 reaches the notch of the installation groove 110, the first guiding slope 311 can be contacted, and the first guiding slope 311 is cooperated with the inner wall of the connecting member 200 to guide the device main body 100 to continue to be inserted into the connecting member 200. In this process, the first guiding slope 311 will be pushed by the connecting member 200, so that the limiting member 300 is driven to rotate to the unlocking position (as shown in FIG. 5). At this time, the first guiding slope 311 will blocked the notch of the installation groove 110, and can continue to guide an inserted side b of the connecting member 200 to move relative to the device main body 100. When the inserted side b of the connecting member 200 crosses the notch of the installation groove 110 and is directly abutted against the outside of the device main body 100, the inserted side b of the connecting member 200 will continue to move relative to the device main body 100 along the outside of the device main body 100. Until the device main body 100 is inserted into place, that is, when the notch of the installation groove 110 is opposite to the notch of the limiting clamping groove 210, as shown in FIG. 6, the limiting member 300 is rotated to the locking position, and the limiting clamping convex 310 is snapped into the limiting clamping groove 210.

Furthermore, in this embodiment, a second guiding slope 211 is provided on the side of the limiting clamping groove 210 close to the installation port 201. The limiting member 300 moves from the locking position to the unlocking position and can separate from the limiting clamping groove 210 through the second guiding slope 211. When the limiting clamping groove 210 is opposite to the notch of the installation groove 110, the limiting member 300 moves from the unlocking position to the locking position, and can also be snapped into the limiting clamping groove 210 through the second guiding slope 211. The second guiding slope 211 can guide the limiting clamping convex 310 in and out of the limiting clamping groove 210, which further improves the convenience of disassembly and assembly of the connecting member 200 and the device main body 100, and is conducive to improving the user's operating experience in replacing the band body.

Furthermore, in this embodiment, the wearable device further includes a reset member, which can act on the limiting member 300, so that the limiting member 300 has a tendency to move toward the locking position. That is, the limiting member 300 can be in the locking position naturally without the external force. When assembling the connecting member 200 and the device main body 100, after the device main body 100 is inserted into place, that is, when the notch of the installation groove 110 is opposite to the notch of the limiting clamping groove 210, the user does not need to drive the limiting member 300 to rotate. The limiting member 300 can return to the locking position under the action of the reset member, and the limiting clamping convex 310 is correspondingly snapped into the limiting clamping groove 210 under the guidance of the second guiding slope 211. In addition, under the action of the reset member, the limiting member 300 can be stably in the locking position, and the limiting clamping convex 310 can be stably snapped into the limiting clamping groove 210, so that the device main body 100 is stably connected to the connecting member 200. In this way, the convenience of installation of the band body and the device main body 100 can be further improved, which is conducive to further improving the user's operating experience of replacing the band body. In other embodiments, a limiting structure may be provided on the device main body 100 to cooperate with the limiting member 300 when it is in the locking position, so that the limiting member 300 can be stably in the locking position. After the limiting member 300 is released, the limiting member 300 can be driven to move towards the unlocking position.

Further, in this embodiment, as shown in FIG. 1 and FIG. 4 to FIG. 6, the reset member includes a first magnetic member 400 provided in the device main body 100 and a second magnetic member 500 provided in the limiting member 300. The first magnetic member 400 is relative to the second magnetic member 500, and the first magnetic member 400 is interacted with the second magnetic member 500, so that the limiting member 300 has a tendency to move toward the locking position. In this way, under the constraints of the magnetic force between the first magnetic member 400 and the second magnetic member 500, the limiting member 300 can naturally be in the locking position. When the limiting member 300 is subjected to enough external force to overcome the magnetic force between the first magnetic member 400 and the second magnetic member 500, for example, when the device main body 100 is inserted into the connecting member 200, the inserted side b of the connecting member 200 exerts a force on the limiting member 300 through the first guiding slope 311, and the limiting member 300 can be rotated and reach the unlocking position. In other embodiments, the reset member may be elastic, and under the action of the elastic force of the reset member, the limiting member 300 has the tendency to move toward the locking position.

Further, in this embodiment, as shown in FIG. 4 to FIG. 6, the installation groove 110 is provided with a first groove wall 111 and a second groove wall 112 is opposite to the first groove wall 111, the first magnetic member 400 is provided on the first groove wall 111, the opposite sides of the first magnetic member 400 and second magnetic member 500 are of the same magnetic poles. The first magnetic member 400 repels the second magnetic member 500, so that the limiting member 300 is abutted against the second groove wall 112, and the limiting member 300 reaches the locking position. It can be understood that there is enough space between the first groove wall 111 and the second groove wall 112 for the limiting member 300 to rotate. In this embodiment, when the limiting member 300 is abutted against the first groove wall 111, the limiting member 300 reaches the unlocking position. When the limiting member 300 is abutted against the second groove wall 112, the limiting member 300 reaches the locking position. At this time, under the action of the magnetic repulsion between the second magnetic member 500 on the limiting member 300 and the first magnetic attracting member of the first groove wall 111, if the limiting member 300 is not subject to external force, it can be stable in the locking position, so that the band body is fixed to the device main body 100. In other embodiments, the first magnetic member 400 may be provided on the second groove wall 112, the opposite sides of the first magnetic member 400 and the second magnetic member 500 are of different magnetic poles, and the first magnetic member 400 is attracted to the second magnetic member 500, so that the limiting member 300 is abutted against the second groove wall 112, and the limiting member 300 reaches the locking position, or one of the second groove wall 112 and the limiting member 300 is provided with a magnet, and the other one of the second groove wall 112 and the limiting member 300 is provided with a ferromagnet material, so that the limiting member 300 is also subjected to the magnetic attractive force from the second groove wall 112.

Further, in this embodiment, as shown in FIG. 1 and FIG. 4 to FIG. 6, the wearable device also includes a driving member 600 movable in the device main body 100 to have a first position and a second position. The driving member 600 is provided with a trigger end 610 exposed outside the device main body 100. The driving member 600 moves from the first position to the second position, and can drive the limiting member 300 to move from the locking position to the unlocking position. After the user applies force to the trigger end 610 to drive the driving member 600 to move relative to the device main body 100, when the driving member 600 moves to the second position, the limiting member 300 can rotate to the unlocking position, and the user can take out the device main body 100 from the connecting member 200. In other embodiments, the limiting member 300 may have a part exposed on the device main body 100 and can be driven by the user.

Further, in this embodiment, as shown in FIG. 1 and FIG. 5, the device main body 100 is also provided with a guiding groove 120 connected to the installation groove 110, and the driving member 600 is movably installed in the guiding groove 120 and moves between the first position and the second position along a groove depth direction of the guiding groove 120. Under the guidance of the guiding groove 120, the driving member 600 can move stably between the first position and the second position. In this embodiment, the guiding groove 120 is provided through the second groove wall 112. At least when the driving member 600 is in the first position, the trigger end 610 is exposed outside the second groove wall 112 to facilitate the user to apply force. The driving member 600 is also provided with an action end 620 away from the trigger end 610. When the limiting member 300 in the locking position is abutted against the second groove wall 112, it should have a part relative to the guiding groove 120. In this way, when the user disassembles the band body and the device main body 100, the trigger end 610 can be pressed to drive the driving member 600 to move to the second position, and the action end 620 can push the limiting member 300, so that the limiting member 300 moves in the direction close to the first groove wall 111, that is, the trend limiting member 300 moves toward the unlocking position. When the limiting member 300 is in the locking position, the limiting member 300 is abutted against the second groove wall 112, and the driving member 600 is in the first position. At this time, there should be no force between the action end 620 and the limiting member 300, or the force exerted by the action end 620 on the limiting member 300 is not enough to overcome the magnetic repulsion, so that the limiting member 300 can be stable in the locking position. In other embodiments, the limiting member 300 can be fixedly connected to a rotating shaft, the rotating shaft is rotatably connected to the groove wall of the installation groove 110, and the driving member 600 is fixedly connected to the end of the rotating shaft. The limiting member 300 can be driven to rotate by rotating the driving member 600.

Figure 7:
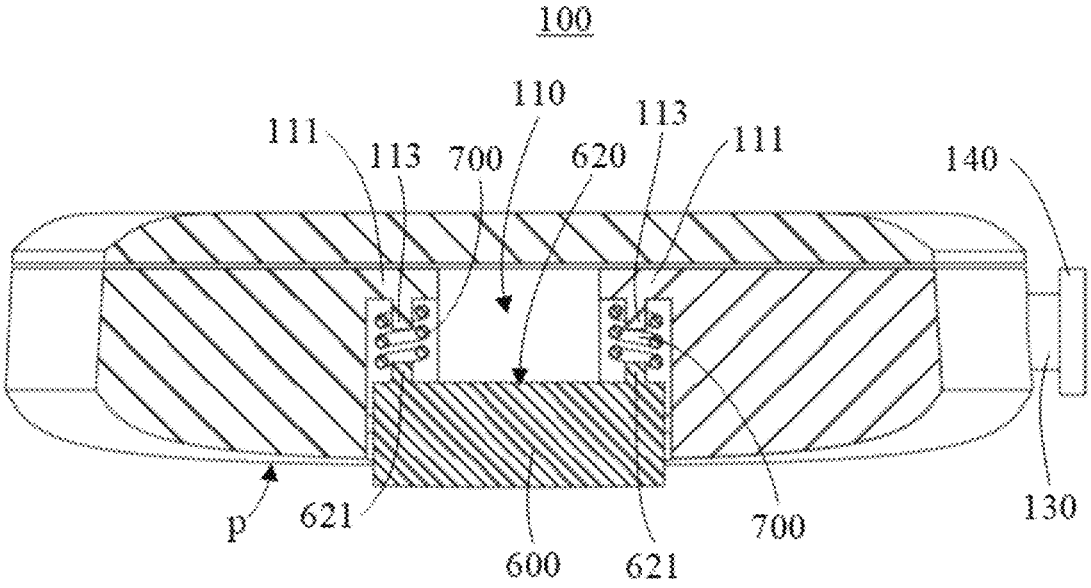
FIG. 7 is a cross-sectional view of the wearable device according to an embodiment of the present application.

Further, in this embodiment, as shown in FIG. 7, the device main body 100 is also provided with an elastic member 700. The elastic member 700 can act on the driving member 600 so that the driving member 600 has the tendency to move to the first position. That is, the driving member 600 will be in the first position naturally and stably without being acted upon by external force. It can be understood that when the driving member 600 is in the first position, the driving member 600 will not interfere with the movement of the limiting member 300 in the installation groove 110, thereby facilitating the user to assemble the connecting member 200 and the device main body 100. When the user disassembles the connecting member 200 and the device main body 100, one side of the device main body 100 exposed with the trigger end 610 can be pressed against the desktop or countertop, and the driving member 600 can also be driven to the second position, thereby driving the limiting member 300 to reach the locking position. The limiting clamping convex 310 is separated from the limiting clamping groove 210. The user presses the device main body 100 with one hand and separate the connecting member 200 from the device main body 100 with the other hand. In this way, it is convenient for the user to replace the band body. In other embodiments, the cooperation between the driving member 600 and the guiding groove may be loose, and under the magnetic repulsion between the first magnetic member 400 and the second magnetic member 500, the limiting member 300 moves toward the locking position, which can push the action end 620 so that the driving member 600 returns to the first position.

Further, in this embodiment, as shown in FIG. 4 to FIG. 6, the guiding groove 120 is provided with a first side and a second side opposite to the first side in the groove depth direction, and the first side is provided at a connection between the installation groove 110 and the guiding groove 120. One end of the driving member 600 close to the first side is provided with a first limiting convex portion 630, the guiding groove 120 is provided with a second limiting convex portion 121 on the second side, and the first limiting convex portion 630 is limited to the second limiting convex portion 121 away from the second side, so as to avoid the driving member 600 from coming out of the guiding groove 120 from the second side. The elastic member 700 is provided in the installation groove 110. One end of the elastic member 700 is connected to the groove wall of the installation groove 110, and the other end of the elastic member 700 is connected to an end portion of the driving member 600 close to the first side, that is, the first limiting convex portion 630 of the driving member 600. Under the action of the elastic member 700, the driving member 600 is restricted from coming out of the guiding groove 120 from the first side. Therefore, the driving member 600 can be stably installed in the guiding groove 120 and will neither fall off from the first side into the installation groove 110 nor fall off from the second side outside the device main body 100. In addition, in this embodiment, when the driving member 600 is in the first position, the first limiting convex portion 630 is abutted against the second limiting convex portion 121. Therefore, the cooperation between the first limiting convex portion 630 and the second limiting convex portion 121 can also position for the movement of the driving member 600. Furthermore, one driving member 600 is provided with two elastic members 700 respectively provided on opposite sides of the limiting member 300, and distribution directions of the two elastic members 700 are parallel to a extending direction of a rotation axis of the limiting member 300. In this way, the rotation of the limiting member 300 in the installation groove 110 will not be interfered, and the driving member 600 can be stable in the first position under the action of a relatively uniform elastic force.

Further, in this embodiment, as shown in FIG. 7, the groove wall of the installation groove 110 opposite to the first side is protruded with a first installation convex portion 113, and one end of the driving member 600 close to the first side is correspondingly protruded with a second installation convex portion 621. The elastic member 700 is configured as a spring, and both ends of the spring are respectively installed in the first installation convex portion 113 and the second installation convex portion 621. In this embodiment, the groove wall of the installation groove 110 opposite to the first side is the first groove wall 111, and the end portion of the driving member 600 close to the first side is the action end 620. The two ends of the spring are respectively sleeved on the first installation convex portion 113 on the first groove wall 111 and the second installation convex portion 621 of the action end 620, and the first installation convex portion 113 and the second installation convex portion 621 can play a guiding role during the compression process of the spring. In other embodiments, the elastic member 700 can also be configured as a spring piece, an elastic rubber or an elastic silicone, or the two ends of the elasticity are respectively embedded in the first groove wall 111 of the installation groove 110 and the action end 620 of the driving member 600.

The above descriptions are only embodiments of the present application, and are not intended to limit the scope of the present application. Under the inventive concept of the present application, any equivalent structural transformations made by using the contents of the description and drawings of the present application, or direct/indirect applications in other related technical fields, are included in the scope of the present application.

What is claimed is:

1. A wearable device, comprising:

a connecting member;

a device main body detachably connected to a peripheral wall of the connecting member;

a band body connected to two opposite ends of the connecting member;

a limiting clamping groove provided at one of the connecting member and the device main body;

an installation groove provided on the other one of the connecting member and the device main body, wherein a notch of the installation groove is provided opposite to a notch of the limiting clamping groove;

a limiting member rotatably provided in the installation groove to have a locking position and an unlocking position, wherein the limiting member is provided with a limiting clamping convex for snapping into the limiting clamping groove; and a reset member configured to act on the limiting member, so that the limiting member has a tendency to move toward the locking position;

wherein in the locking position, the limiting clamping convex is exposed to the notch of the installation groove and snapped into the limiting clamping groove;

in the unlocking position, the limiting clamping convex is separated from the limiting clamping groove;

the installation groove is provided in the device main body, and the limiting clamping groove is formed in the connecting member; and the reset member comprises a first magnetic member provided on the device main body and a second magnetic member provided on the limiting member, the first magnetic member is provided opposite to the second magnetic member, and the first magnetic member is interacted with the second magnetic member, so that the limiting member has the tendency to move toward the locking position.

2. The wearable device of claim 1, wherein the installation groove is provided with a first groove wall and a second groove wall opposite to the first groove wall;

the first magnetic member is provided on the first groove wall, and opposite sides between the first magnetic member and the second magnetic member are of a same magnetic pole; the first magnetic member is repelled with the second magnetic member so that the limiting member is abutted against the second groove wall, and the limiting member reaches the locking position; or the first magnetic member is provided on the second groove wall, and opposite sides between the first magnetic member and the second magnetic member are of a different magnetic pole; the first magnetic member is attracted to the second magnetic member, so that the limiting member is abutted against the second groove wall, and the limiting member reaches the locking position.

3. The wearable device of claim 1, further comprising:

a driving member movably provided in the device main body to have a first position and a second position;

wherein the driving member is provided with a trigger end exposed outside the device main body; and the driving member is configured to move from the first position to the second position, and configured to drive the limiting member to move from the locking position to the unlocking position.

4. The wearable device of claim 3, wherein the device main body is further provided with a guiding groove communicated with the installation groove, and the driving member is movably installed in the guiding groove and configured to move between the first position and the second position along a groove depth direction of the guiding groove.

5. The wearable device of claim 4, wherein the device main body is further provided with an elastic member configured to act on the driving member, so that the driving member has a tendency to move toward the first position.

6. The wearable device of claim 5, wherein the guiding groove is provided with a first side and a second side opposite to the first side in the groove depth direction, and the first side is provided at a connection between the installation groove and the guiding groove; and one end of the driving member close to the first side is provided with a first limiting convex portion, the second side of the guiding groove is provided with a second limiting convex portion, and the first limiting convex portion is limited to one side of the second limiting convex portion away from the second side, so as to avoid the driving member separating from the guiding groove through the second side.

7. The wearable device of claim 6, wherein the elastic member is provided in the installation groove; one end of the elastic member is connected to a wall of the installation groove, and the other end of the elastic member is connected to an end portion of the driving member close to the first side; the driving member is avoided separating from the guiding groove through the first side under an action of the elastic member.

8. The wearable device of claim 6, wherein a first installation convex portion is protruded on a wall of the installation groove opposite to the first side, and a second installation convex portion is protruded at one end portion of the driving member close to the first side; the elastic member is configured as a spring, and both ends of the spring are respectively installed on the first installation convex portion and the second installation convex portion.

9. The wearable device of claim 1, wherein the device main body is provided with a positioning convex portion, and the connecting member is provided with a positioning breach; the positioning convex portion is snapped into the positioning breach, and the limiting clamping convex is snapped into the limiting clamping groove.

10. The wearable device of claim 1, further comprising:

a wearing side, wherein the connecting member is provided with an installation port provided on the wearing side, and the device main body is installed into the connecting member from the installation port.

11. The wearable device of claim 10, wherein the limiting clamping convex is provided with a first guiding slope away from the wearing side of the device main body; in response to that the limiting member is in the locking position, the first guiding slope is configured to guide the device main body to be installed into the connecting member from the installation port and to be pushed so that the limiting member reaches the unlocking position.

12. The wearable device of claim 10, wherein a second guiding slope is provided on one side of the limiting clamping groove close to the installation port, and the limiting member is configured to move from the locking position to the unlocking position and separate from the limiting clamping groove through the second guiding slope.

13. The wearable device of claim 10, wherein a first slope is formed on an outer peripheral edge of the device main body, and a second slope parallel to the first slope is formed on a peripheral wall of the connecting member; the second slope is extended inwardly from the installation port; the first slope is cooperated with the second slope to guide the device main body to separate from the connecting member through the installation port and avoid the device main body separating from the connecting member through an opposite side of the installation port.

14. The wearable device of claim 10, wherein a limiting portion is protruded on an inner circumference of the connecting member, and the limiting portion is provided on the opposite side of the installation port to avoid the device main body separating from the connecting member through the opposite side of the installation port.

* * * * *